US010850153B1

(12) United States Patent
Sorin

(10) Patent No.: US 10,850,153 B1
(45) Date of Patent: Dec. 1, 2020

(54) FOLDAWAY SAFETY BAR APPARATUS AND METHODS OF USING SAME

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 0 days.

(21) Appl. No.: 16/807,886

(22) Filed: Mar. 3, 2020

(51) Int. Cl.
*A63B 21/078* (2006.01)

(52) U.S. Cl.
CPC ..... *A63B 21/0783* (2015.10)

(58) Field of Classification Search
CPC ..... A63B 21/072; A63B 71/02; A63B 17/00; A63B 71/00; A63B 21/078; F16M 13/027; A47B 5/00; A47B 5/06; A47B 85/00; D06F 81/06
See application file for complete search history.

(56) References Cited

U.S. PATENT DOCUMENTS 5,954,619 A * 9/1999 Petrone ..... A63B 71/0036 482/104
6,149,556 A * 11/2000 Jordan ..... A63B 71/0036 482/104
D441,813 S * 5/2001 Ceppo ..... 482/104
8,740,760 B2 * 6/2014 York ..... A63B 21/078 482/104
10,507,352 B2 * 12/2019 Kimura ..... A63B 21/078

OTHER PUBLICATIONS

Webpage: Half Safety Bars; Jan. 2005; https://www.sorinex.com/products/half-safety-spotter-bars.

* cited by examiner

*Primary Examiner* — Jennifer Robertson
*Assistant Examiner* — Andrew M Kobylarz
(74) *Attorney, Agent, or Firm* — Todd Allen Serbin; Nexsen Pruet, LLC

(57) ABSTRACT

A safety bar apparatus for removable and rotatable attachment to a weight rack, comprising: a main body having an upper-facing side including a landing surface; an upper aperture located on a back side bracket of the main body, the upper aperture defining a rotational axis of the main body; and, a lower aperture located on the back side bracket downwardly from the upper aperture, wherein the main body is sized, shaped and configured to rotate from a horizontal deployed configuration to a vertical stowed configuration around a rotational axis defined by the upper aperture.

19 Claims, 6 Drawing Sheets

FOLDAWAY SAFETY BAR APPARATUS AND METHODS OF USING SAME

FIELD OF THE INVENTION

The present invention, in some embodiments thereof, relates to physical exercise and, more particularly, but not exclusively, to a strength training implement.

BACKGROUND OF THE INVENTION

Spotter or safety arms/bars are used in the weight lifting field to restrict movement of a weightlifting instrument, such as a weight bar. For example, safety arms are typically rigidly connected to a weight rack to catch the weight bar in case of mishandling of the weight bar by or physical failure of the user (weightlifter and/or a spotter). These safety arms are maximized for mechanical support of a loaded weight bar and/or to ensure that they can catch a dropped, loaded weight bar if necessary, for the safety of the user. Such safety arms can be found for sale by Sorinex Exercise Equipment, Inc. at sorinex.com/products/half-safety-spotter-bars.

SUMMARY OF THE INVENTION

According to an aspect of some embodiments of the present invention there is provided a safety bar apparatus for removable and rotatable attachment to a weight rack, comprising: a main body having an upper-facing side including a landing surface; an upper aperture towards the back of the main body, the upper aperture defining a rotational axis of the main body; and, a lower aperture towards the back of the main body; wherein the main body is sized, shaped and configured to rotate from a horizontal deployed configuration to a vertical stowed configuration around a rotational axis defined by the upper aperture.

In an embodiment of the invention, the landing surface is substantially flat. In an embodiment of the invention the landing surface is protected and/or softened by a layer of material on top of the landing surface.

In an embodiment of the invention, the safety bar apparatus further comprises at least one pin insertable into at least one of the upper aperture and lower aperture.

In an embodiment of the invention, the safety bar apparatus further comprises a bar shield disposed towards the back of the landing surface on the main body.

In an embodiment of the invention, the bar shield has an upward facing J-cup surface, when in the stowed configuration.

In an embodiment of the invention, the safety bar apparatus further comprises a handle disposed on a front end of the safety bar apparatus.

In an embodiment of the invention, the safety bar apparatus further comprises wherein the handle is shaped in a loop-like manner.

In an embodiment of the invention, the safety bar apparatus further comprises additional attachment apertures along the length of the main body.

In an embodiment of the invention, the additional attachment apertures are spaced such that they correspond to rack apertures located on the weight rack.

In an embodiment of the invention, the main body is shaped like an upside down U, wherein the landing surface faces in a direction opposite the U.

In an embodiment of the invention, both sides of the main body extending outwardly from the bar shield are flat.

In an embodiment of the invention, the bar shield includes a rounded corner where the bar shield intersects the main body.

According to an aspect of some embodiments of the present invention there is further provided a method of using a safety bar apparatus for removable and rotatable attachment to a weight rack, comprising: rotating a main body of the safety bar apparatus around a rotational axis defined by a first pin inserted into an upper aperture of the main body to transition the safety bar apparatus from a vertical stowed configuration to a horizontal deployed configuration; inserting a second pin into a lower aperture of the main body to restrict rotational movement of the main body while in the deployed configuration; removing the second pin from the lower aperture; and, lowering the main body to abut the weight rack to transition the safety bar apparatus from the deployed configuration to the stowed configuration.

In an embodiment of the invention, the method further comprises using a J-cup surface of a bar shield of the main body while the safety bar apparatus is in the stowed configuration.

In an embodiment of the invention, the method further comprises inserting the second pin into the lower aperture when the safety bar apparatus is in the stowed configuration to prevent rotational movement of the main body while in the stowed configuration.

In an embodiment of the invention, the method further comprises using a landing surface located on an upper-facing side of the main body during the performance of exercise and while the safety bar apparatus is in the deployed configuration.

In an embodiment of the invention, the lowering the main body to abut the weight rack is achieved by using an upside down U-shaped or flat main body.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
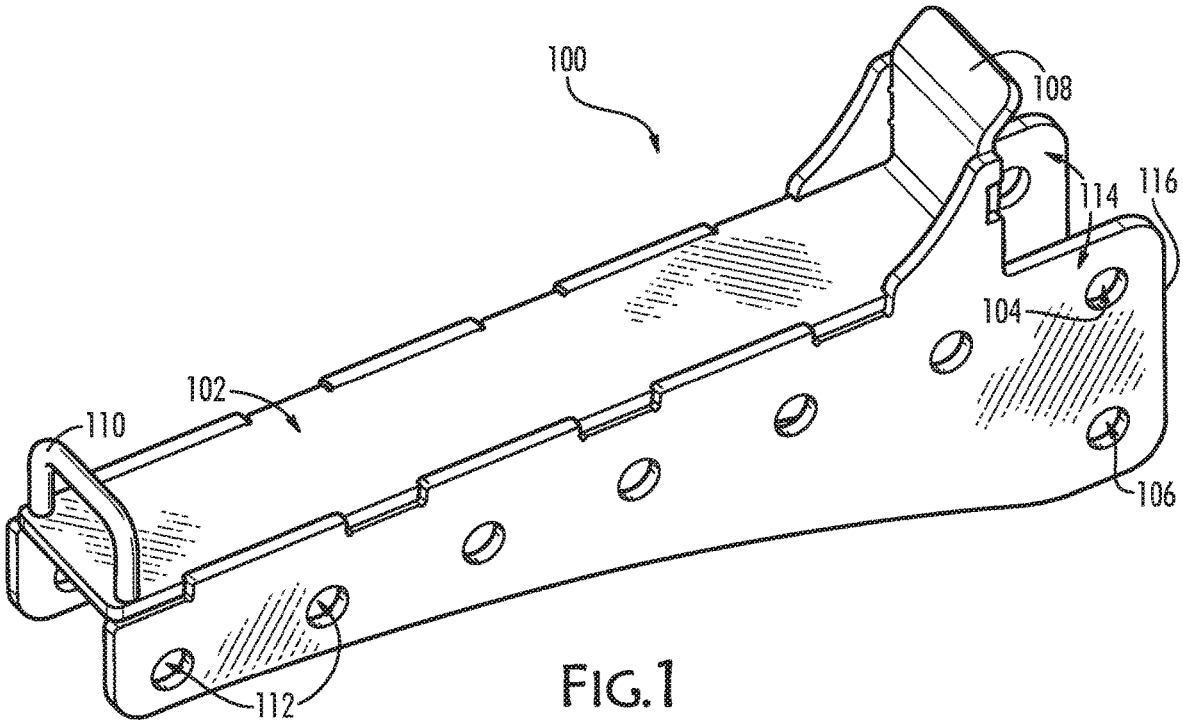
FIG. 1 is a perspective view of a safety bar apparatus, in accordance with an exemplary embodiment of the invention.

The present invention, in some embodiments thereof, relates to physical exercise and, more particularly, but not exclusively, to a strength training implement.

Before explaining at least one embodiment of the invention in detail, it is to be understood that the invention is not necessarily limited in its application to the details of construction and the arrangement of the components and/or methods set forth in the following description and/or illustrated in the drawings. As used herein "upper", "top" or "upward" refer to a side of a structure which is away from the floor or consists of movement away from the floor, whereas "lower", "downward" and "bottom" refer to a side of a structure which faces the floor or consists of movement towards the floor. Also as used herein, the "front" of the structure refers to an open ended side, not connected to a weight rack, whereas the "back" or "back side" is opposite the front and is on the side of the structure closest to the weight rack to which the structure is connected. The invention is capable of other embodiments or of being practiced or carried out in various ways.

Figure 3A:
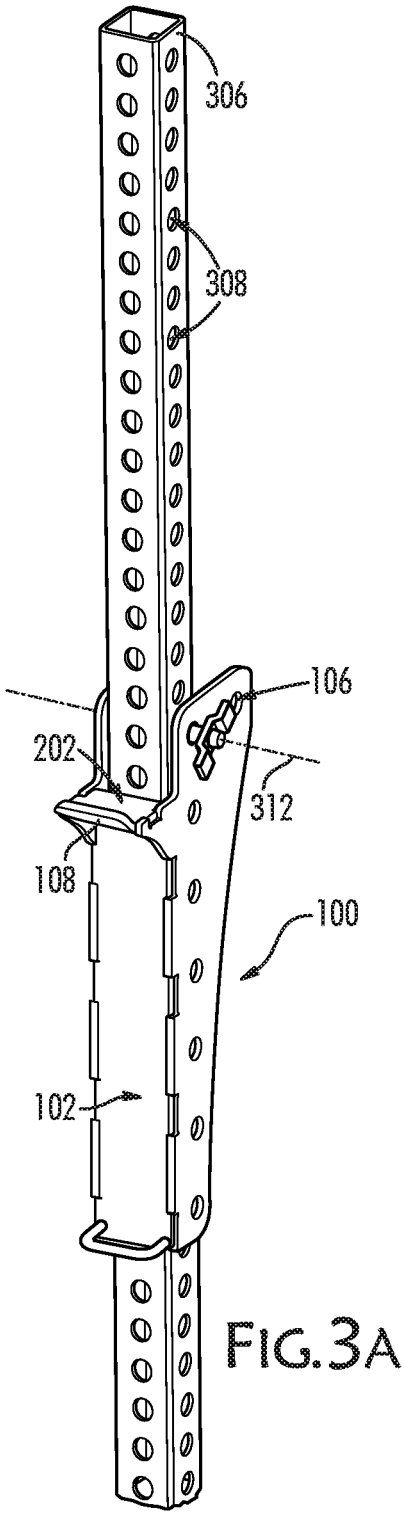
FIG. 3A is a perspective view of a stowed safety bar apparatus, in accordance with an exemplary embodiment of the invention.

Referring now to the drawings, FIG. 1 is a perspective view of a safety bar apparatus 100, in accordance with an exemplary embodiment of the invention. Generally, the safety bar apparatus 100 has a main body that protrudes from a weight rack (described in more detail below) and which includes a landing surface 102 on an upper-facing side of the main body, on which weight lifting instruments, such as weight bars, can be placed during exercise and/or even for storage of the weight lifting instruments when not in use (i.e. theoretically, the weight bar could simply lay at rest on the landing surface 102 until needed again). In some embodiments of the invention, the landing surface 102 is substantially flat. In some embodiments of the invention, the landing surface 102 is protected and/or softened by a layer of durable material on top of the landing surface 102, for example a plastic, polymer, rubber and/or rubber-like material. As shown in FIG. 3A, the safety bar apparatus 100 is typically removably and/or adjustably attached to a weight rack 306, the details of which are described below. In an embodiment of the invention, attachment of the safety bar apparatus 100 is accomplished by using pins (302, 304 shown in FIGS. 3A-3B) which are inserted through an upper aperture 104 and a lower aperture 106, depending on the configuration of the safety bar apparatus 100, which are located on a back side bracket 114 of the safety bar apparatus. In an embodiment of the invention, the back side bracket 114 is sized, shaped and configured as a counterpart to the weight rack 306 in a similar fashion as the remaining portion of the safety bar apparatus 100, such as described below with respect to FIG. 3A.

In some embodiments of the invention, a bar shield 108 is disposed towards the back of the landing surface 102. It should be noted that in some embodiments of the invention, the bar shield 108 is located on the safety bar apparatus 100 in combinational position with with the back side bracket 114 (and/or at least the upper aperture) to enable at least a portion of the bar shield 108 to rest against the weight rack 306 in a flush manner while the safety bar apparatus 100 is also substantially horizontal when in a deployed configuration, as described in more detail below. In some embodiments of the invention, the farthest back any part of the bar shield 108 is disposed is 1-4 inches from a back edge 116 of the apparatus 100 between the back edge 116 and the landing surface 102. Optionally, the farthest back any part of the bar shield is disposed is 0.5-2.5 inches from the center of the upper and/or lower apertures.

The bar shield 108 optionally performs a multitude of functions, including: acting as a back stop for weight lifting instruments which are placed haphazardly onto the landing surface 102 when the apparatus is in the deployed configuration (e.g. where the instrument is placed downwardly but also with movement towards the weight rack 306); as a spacer/barrier to provide physical contact between the safety bar 100 and the weight rack 306 for additional mechanical stability; and/or for providing a J-hook a.k.a. J-cup surface 202 (shown and described in more detail with respect to FIG. 2) when the safety bar apparatus 100 in the stowed configuration (shown in FIG. 3A).

Figure 3B:
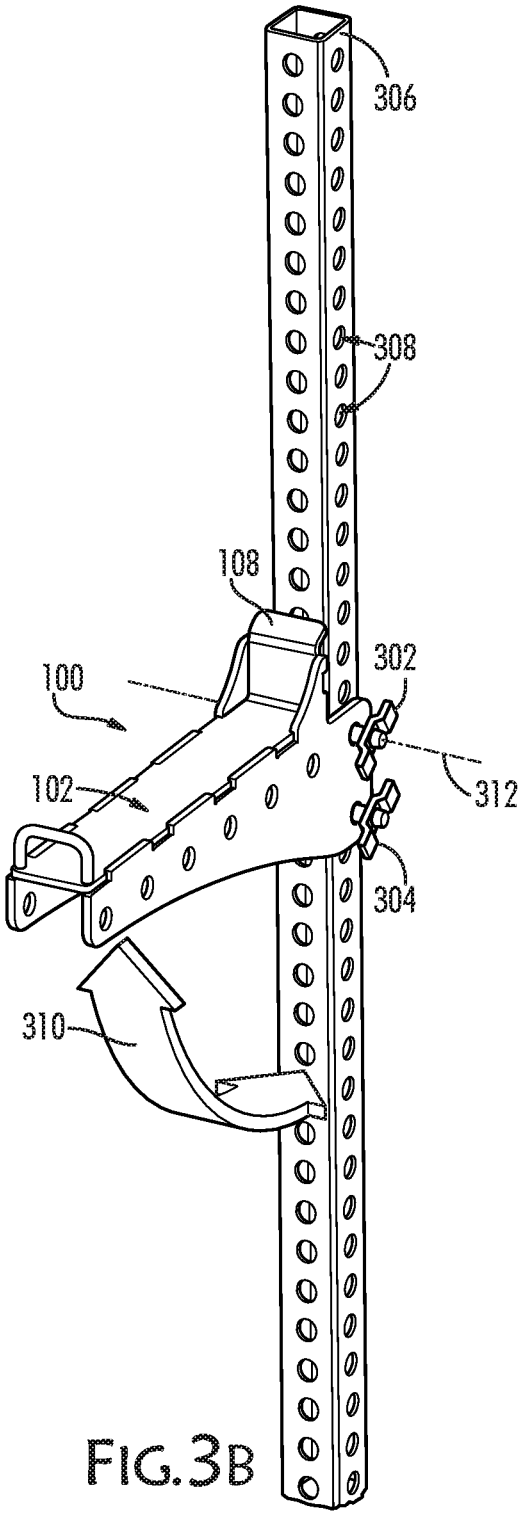
FIG. 3B is a perspective view of a deployed safety bar apparatus, in accordance with an exemplary embodiment of the invention.

In an embodiment of the invention, a handle 110 is disposed on the safety bar apparatus 100, for example towards a front end of the apparatus 100. The handle 110 is usable to for a user to grip to transition the safety bar apparatus 100 from the stowed configuration to a deployed configuration (such as shown in FIG. 3B) and back again. In some embodiments, the handle 110 is also useful for acting as a barrier for preventing a weight lifting instrument from rolling or falling off the front of the safety bar 100. In addition, the handle 110 can be shaped in a loop-like manner enabling something to be clipped to it, for example, a strap or harness, regardless of which configuration the safety bar 100 is in.

In some embodiments of the invention, additional attachment apertures 112 are provided along the length of the safety bar apparatus 100, which are optionally used to provide additional attachment points between the safety bar apparatus 100 and the weight rack 306, or even additional weight lifting implements or instruments. In an embodiment of the invention, the additional attachment apertures 112 are spaced such that they correspond to rack apertures 308, shown and described in more detail with respect to FIG. 3A, located on the weight rack. In some embodiments of the invention, the length of the safety bar apparatus is anywhere between 6 inches and 36 inches, although longer or shorter lengths could also be used.

In some embodiments of the invention, some or all of the safety bar apparatus 100 is made from a durable metal material, for example steel, iron and/or aluminum. The safety bar apparatus 100 is constructed by welding, casting, bending, and/or other methods known in the art for metal part fabrication.

As described elsewhere herein, the safety bar apparatus 100 is often used with at least one other safety bar apparatus (not shown) creating two parallel landing surfaces 102 for placement of a weight lifting instrument thereon. It should also be understood that the safety bar apparatus 100 could be completely removed from the weight rack 306 by removing the pins 302, 304 and then taking the safety bar apparatus 100 off the rack. Optionally, the safety bar apparatus 100 could be mounted on any side of the weight rack 306 by completely removing the pins and apparatus and repositioning it somewhere else using at least one of the pins. Vertical movement of the apparatus 100 can be achieved by removing the pins and sliding the apparatus 100 up or down the weight rack and then re-securing it in place using at least one of the pins. It is conceived that the safety bar apparatus 100 replaces and/or substitutes for at least one conventional half safety bar apparatus used in the weightlifting field today, but with the advantages over these conventional apparatuses described herein.

Figure 2:
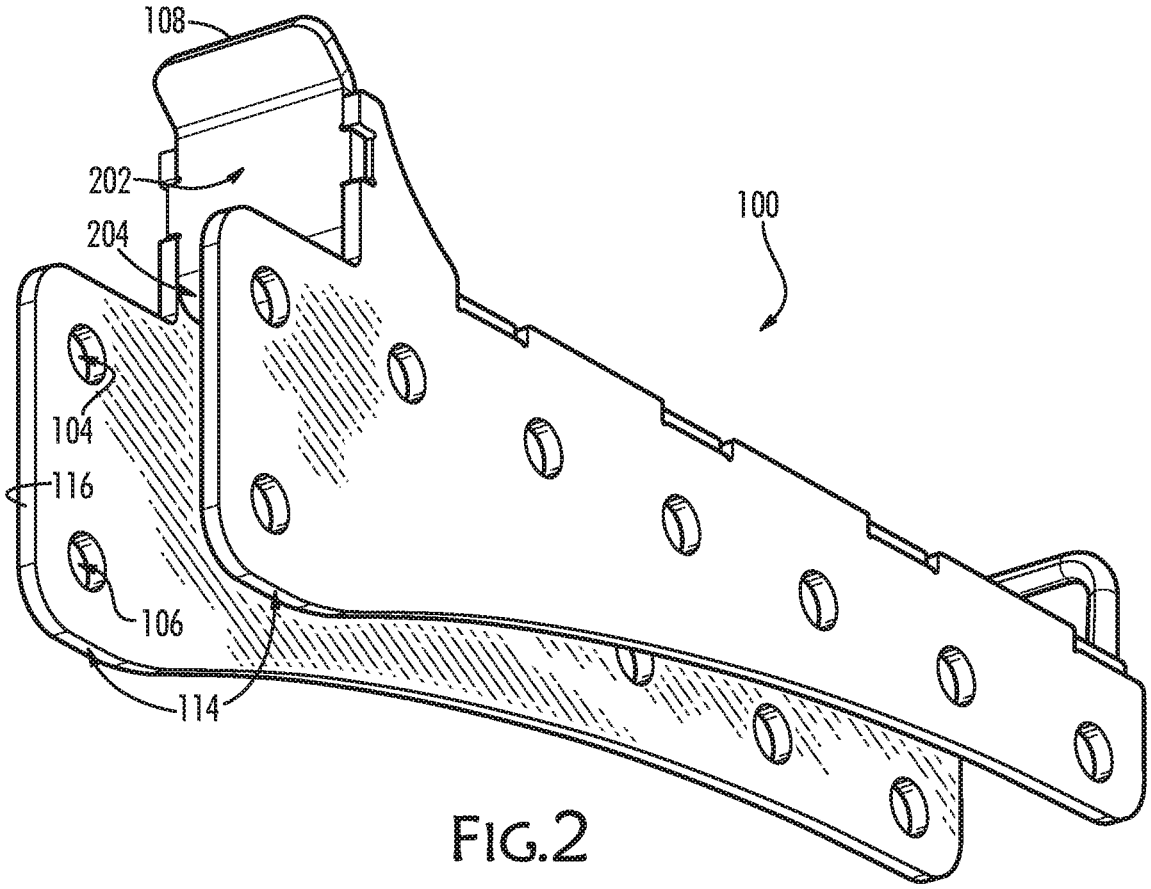
FIG. 2 is a perspective rear view of a safety bar apparatus, in accordance with an exemplary embodiment of the invention.

FIG. 2 is a perspective rear view of a safety bar apparatus 100, in accordance with an exemplary embodiment of the invention. From this perspective, the J-cup surface 202 can more readily be seen, along with the generally U-shaped configuration of the bar shield 108, wherein the U-shape faces towards the weight rack 306 when the apparatus 100 is in the deployed configuration (such as shown in FIG. 3B) and wherein the J-cup surface 202 faces upwardly when in the stowed configuration (such as shown in FIG. 3A).

In some embodiments of the invention, a lower corner 204 of the bar shield 108, where the bar shield intersects the main body of the safety bar apparatus, is rounded to ease rotation of the safety bar apparatus 100 around a rotation axis 312 (shown and described in more detail with respect to FIG. 3B) and between the stowed and deployed configurations.

FIG. 3A is a perspective view of the safety bar apparatus 100 in the stowed configuration, in accordance with an exemplary embodiment of the invention. It should be understood that by being able to rotate downwardly when in the stowed configuration, the safety bar apparatus 100 is transitioned to a substantially reduced profile, which enhances safety in and around the weight lifting space around the weight rack 306. That is, conventional safety bars are attached to the weight rack and permanently jut out into the spaces around the weight rack, creating obstacles which extend into the horizontal spaces around the weight rack which are inherent safety risks to users of the rack when the safety bars are not actually in use. Additionally, by being able to conveniently stow the safety bar 100 away, the gym space is more efficiently usable overall.

In an embodiment of the invention, the safety bar apparatus 100 is sized and shaped to generally act as a counterpart to the weight rack 306, such that the safety bar apparatus 100 fits with a close tolerance to the weight rack 306 while still being freely moveable (e.g. up and down the rack)/rotatable with respect to the weight rack 306. In an embodiment of the invention a first pin 302 is inserted through the upper aperture 104 and through a rack aperture 308 to removably attach the safety bar apparatus 100 to the weight rack 306. In this configuration, a second pin (not shown) is optionally inserted into the lower aperture 106 to provide additional stability to the safety bar apparatus 100 when in the stowed configuration (wherein the second pin prevents material rotational movement of the safety bar apparatus 100 without removal of the second pin).

The J-cup surface 202 is disposed in a generally horizontal position when the safety bar apparatus 100 is in the stowed configuration, in an embodiment of the invention. Using this structural arrangement, the safety bar apparatus 100 performs two important functions using a single weight lifting implement, wherein the J-cup is used as a different type of holder for weight lifting instruments, such as weight bars. In the industry today, two different implements are used, and further, the conventional safety bar is not stowable. In some embodiments of the invention, the J-cup surface 202 is layered and/or softened similarly to the landing surface 102. It should be understood that J-cups and safety bars are often used in conjunction with different weight lifting exercises and the ability of the presently described safety bar 100 to quickly and conveniently transform from one configuration to the other has benefits to the actual performance of exercise, in addition to its safety and efficiency benefits.

FIG. 3B is a perspective view of the safety bar apparatus 100 in the deployed configuration, in accordance with an exemplary embodiment of the invention. In some embodiments of the invention, the second pin 304 is inserted into the lower aperture 106 to reversibly lock the safety bar apparatus 100 to the weight rack 306 to prevent rotation 310 of the safety bar apparatus 100 around the rotational axis 312 created by the first pin 302 inserted through the upper aperture 104. In some embodiments of the invention, the upper aperture 104 and lower aperture 106 are spaced apart such that they will each match up to a respective rack aperture 308 of the weight rack 306.

As FIGS. 3A and 3B are shown on Sheet 3 of the Drawings relative to each other, they could together be viewed as a typical set-up where two safety bar apparatuses 100 are used in parallel on two vertical weight rack 306 elements, where a user could stand in between the two weight rack elements and perform exercises while also using the parallel safety bar apparatuses 100, either in the stowed or the deployed configurations.

Figure 4:
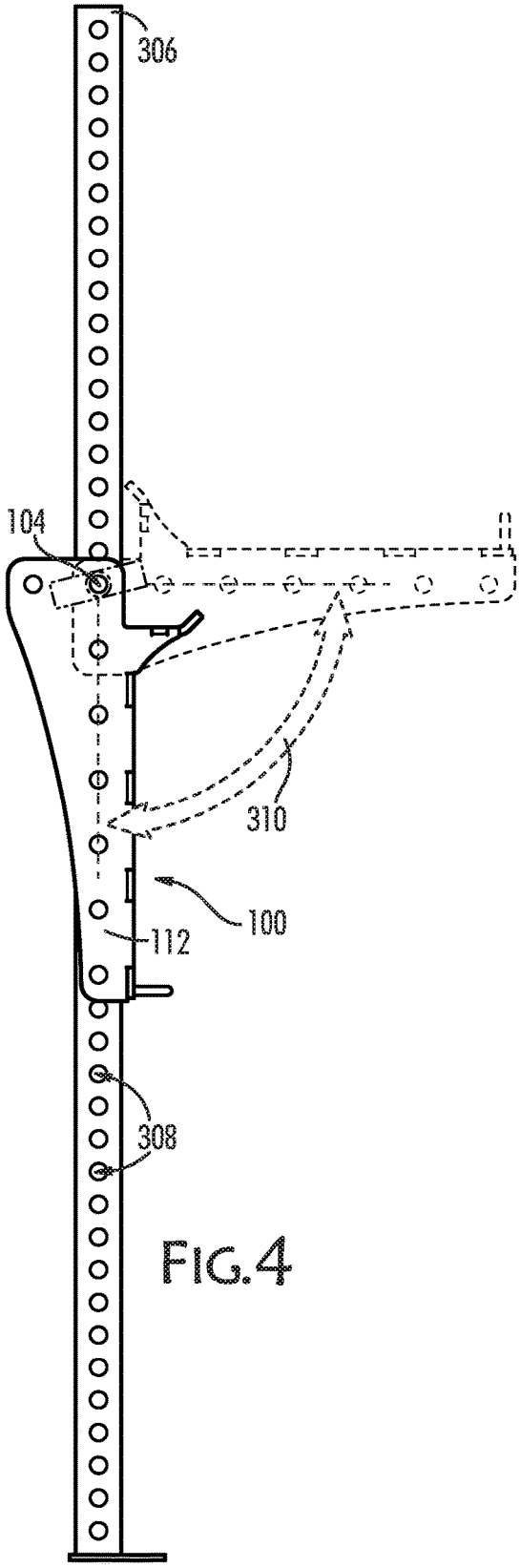
FIG. 4 is a left side view of a stowed safety bar apparatus, in accordance with an exemplary embodiment of the invention.
Figure 5:
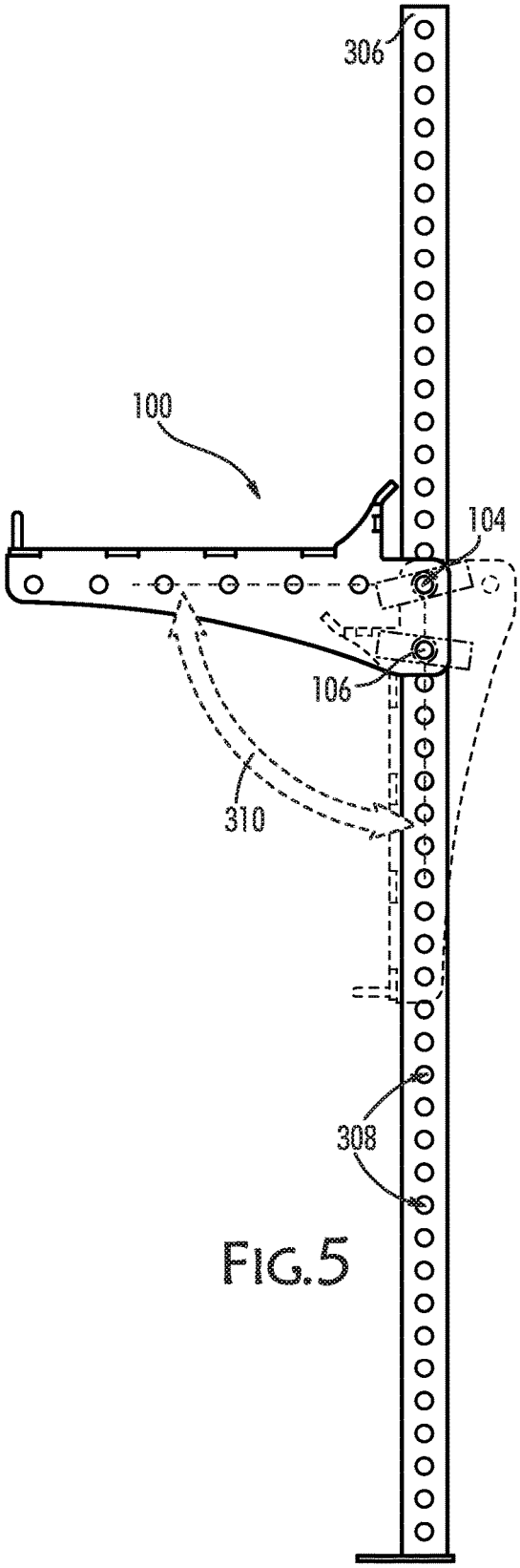
FIG. 5 is a right side view of a deployed safety bar apparatus, in accordance with an exemplary embodiment of the invention.
Figure 6:
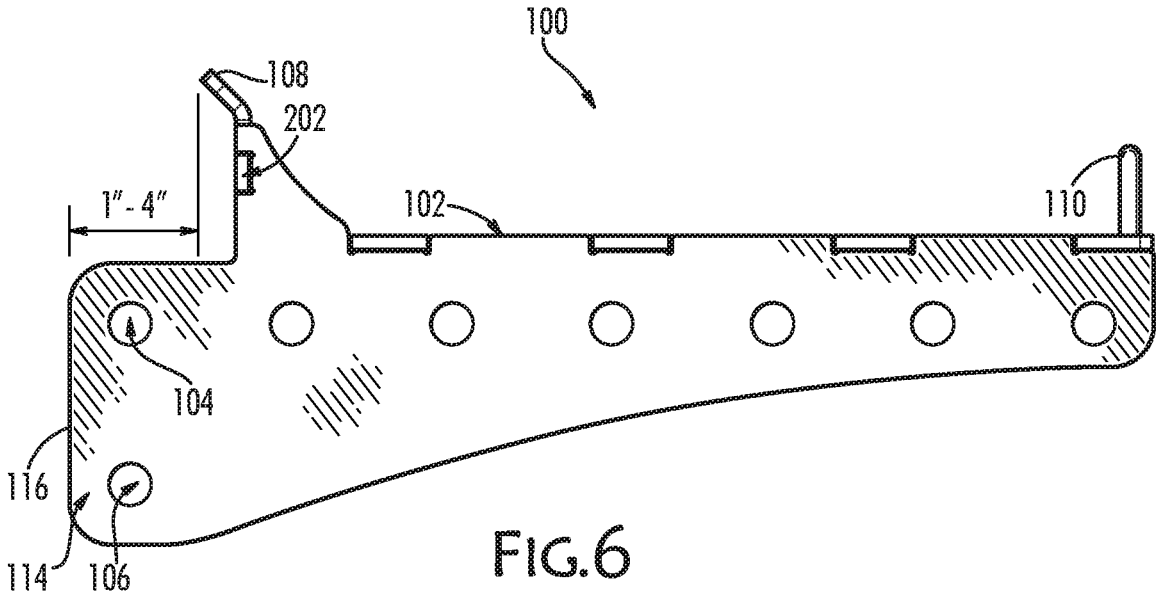
FIG. 6 is a left side view of a safety bar apparatus, in accordance with an exemplary embodiment of the invention.

FIG. 4 is a left side view of the safety bar apparatus 100 in the stowed configuration, in accordance with an exemplary embodiment of the invention. FIG. 5 is a right side view of the safety bar apparatus in the deployed configuration, in accordance with an exemplary embodiment of the invention. FIG. 6 is a left side view of the safety bar apparatus 100, in accordance with an exemplary embodiment of the invention.

Figure 7:
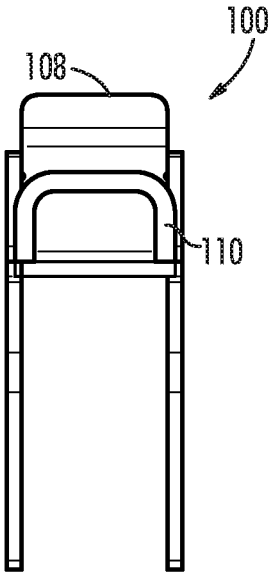
FIG. 7 is a front view of a safety bar apparatus, in accordance with an exemplary embodiment of the invention.

FIG. 7 is a front view of the safety bar apparatus 100, in accordance with an exemplary embodiment of the invention. From this view, the shape and configuration of the safety bar apparatus 100 can be seen, wherein the downwardly facing U-shape is adapted to enable the safety bar apparatus 100 to fully retract towards the weight rack 306 establishing a substantially vertical position parallel to the long axis of the weight rack 306. In some embodiments of the invention, the U shape is squared off. While the safety bar apparatus is shown as having a downwardly facing U-shape, in some embodiments the bar apparatus under the landing surface 102 portion, which extends outwardly from the weight rack, could be flush with the bottom of the landing surface 102 (i.e. the outwardly jutting portion, top and bottom, of the bar apparatus extending outwardly from the rack 306 starting at about the bar shield 108 is flat instead of upside-down U-shaped). This is in contrast to the conventional safety bar apparatuses available today, wherein they are built with a focus on structural and mechanical strength and thus derive direct mechanical support from the weight rack using support legs, which structurally prevent the safety bar from rotating towards the weight rack for stowage.

Figure 8:
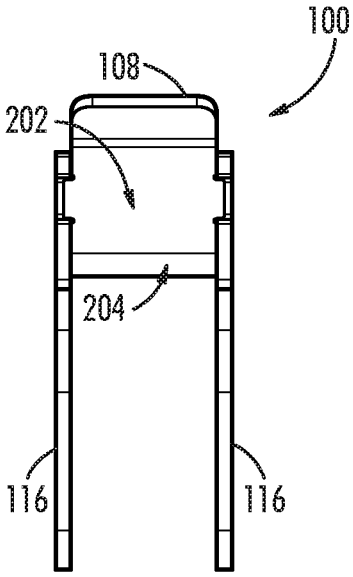
FIG. 8 is a rear view of a safety bar apparatus, in accordance with an exemplary embodiment of the invention.

FIG. 8 is a rear view of the safety bar apparatus 100, in accordance with an exemplary embodiment of the invention.

Figure 9:
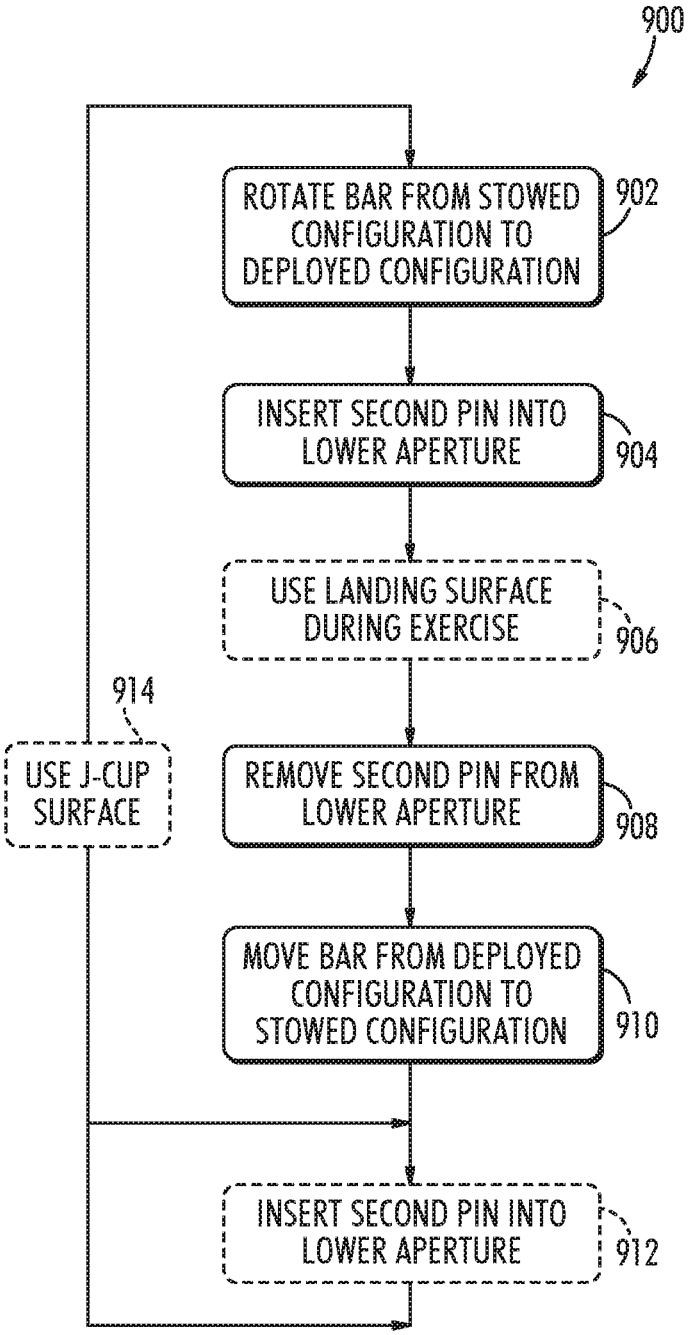
FIG. 9 is a flowchart of a method of using a safety bar apparatus, in accordance with an exemplary embodiment of the invention.

FIG. 9 is a flowchart 900 of a method of using a safety bar apparatus 100, in accordance with an exemplary embodiment of the invention. In an embodiment of the invention, the safety bar apparatus 100 is rotated (902) around the first pin axis 312 from the substantially vertical stowed configuration to the substantially horizontal deployed configuration in order to initiate use of the landing surface 102 of the safety bar apparatus 100. The second pin 304 is inserted (904) into the lower aperture 106 to prevent additional rotation of the safety bar apparatus 100, in either direction.

Once the safety bar apparatus 100 has been reversibly secured in the deployed configuration, the user commences exercise optionally using (906) the landing surface 102, depending on the specific exercises being performed and/or in the event of an exercise mishap.

When it is determined that the landing surface 102 is no longer needed and/or if a different exercise will be conducted where the safety bar apparatus 100 is impeding the space needed for it and/or the user wants to make use of the J-cup surface 202, the user can begin to transition the safety bar apparatus 100 back to the stowed configuration. In an embodiment of the invention, the second pin 304 is removed (908) from the lower aperture 106, enable rotational movement of the bar apparatus 100 about the first pin 302 and the first pin axis 312. The safety bar apparatus 100 is then lowered (910) (rotated downwardly towards the weight rack 306) from the deployed configuration back to the stowed configuration. Optionally, the second pin 304 is inserted into the lower aperture again upon attainment of the stowed configuration to prevent rotational movement of the safety bar apparatus 100.

As described elsewhere herein, when the safety bar apparatus 100 is in the stowed configuration, the upper surface of the bar shield 108 (referred to herein as the J-cup surface 202) is usable (914) to hold weight lifting instruments, such as weight bars. This J-cup surface 202 is usable whether or not the second pin 304 has been inserted (912) into the lower aperture 106 to prevent rotation of the safety bar apparatus 100 in the stowed configuration.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A safety bar apparatus for removable and rotatable attachment to a weight rack, comprising:

a main body having an upper-facing side including a landing surface;

an upper aperture located on a back side bracket of the main body, the upper aperture defining a rotational axis of the main body; and, a lower aperture located on the back side bracket downwardly from the upper aperture;

a bar shield disposed between the back side bracket and the landing surface on the main body wherein the bar shield is not disposed horizontally but has a J-cup surface which is upward facing and disposed horizontally when the safety bar apparatus is in the vertical, stowed configuration, wherein the main body is sized, shaped and configured to rotate from a horizontal deployed configuration to a vertical stowed configuration around a rotational axis defined by the upper aperture.

2. The safety bar apparatus of claim 1, wherein the landing surface is substantially flat.

3. The safety bar apparatus of claim 2, wherein the landing surface is protected and/or softened by a layer of material on top of the landing surface.

4. The safety bar apparatus of claim 1, further comprising a handle disposed on a front end of the safety bar apparatus.

5. The safety bar apparatus of claim 4, further comprising wherein the handle is shaped in a loop-like manner.

6. The safety bar apparatus of claim 1, further comprising additional attachment apertures along the length of the main body.

7. The safety bar apparatus of claim 6, wherein the additional attachment apertures are spaced such that additional attachment apertures correspond to rack apertures located on the weight rack.

8. The safety bar apparatus of claim 1, further comprising at least one pin insertable into at least one of the upper aperture and lower aperture.

9. The safety bar apparatus of claim 1, wherein the main body is U-shaped and the landing surface is disposed on the upper surface of the U, facing in a direction opposite the U.

10. The safety bar apparatus of claim 1, wherein both sides of the main body extending outwardly from the bar shield are flat.

11. The safety bar apparatus of claim 1, wherein the bar shield includes a rounded corner where the bar shield intersects the main body.

12. A method of using a safety bar apparatus for removable and rotatable attachment to a weight rack, comprising:

rotating a main body of the safety bar apparatus around a rotational axis defined by a first pin inserted into an upper aperture of the main body to transition the safety bar apparatus from a vertical stowed configuration to a horizontal deployed configuration;

inserting a second pin into a lower aperture of the main body to restrict rotational movement of the main body while in the deployed configuration;

removing the second pin from the lower aperture;

lowering the main body to abut the weight rack to transition the safety bar apparatus from the deployed configuration to the stowed configuration; and using a J-cup surface of a bar shield of the main body any time the safety bar apparatus is in the stowed configuration.

13. The method of claim 12, further comprising inserting the second pin into the lower aperture when the safety bar apparatus is in the stowed configuration to prevent rotational movement of the main body while in the stowed configuration.

14. The method of claim 12, further comprising using a landing surface located on an upper-facing side of the main body during the performance of exercise and while the safety bar apparatus is in the deployed configuration.

15. The method of claim 12, wherein the lowering the main body to abut the weight rack is achieved by using an upside down U-shaped or flat main body.

16. A method of using a safety bar apparatus for removable and rotatable attachment to a weight rack, comprising:

rotating a main body of the safety bar apparatus around a rotational axis defined by a first pin inserted into an upper aperture of the main body to transition the safety bar apparatus from a vertical stowed configuration to a horizontal deployed configuration;

inserting a second pin into a lower aperture of the main body to restrict rotational movement of the main body while in the deployed configuration;

removing the second pin from the lower aperture;

lowering the main body to abut the weight rack to transition the safety bar apparatus from the deployed configuration to the stowed configuration; and, inserting the second pin into the lower aperture any time the safety bar apparatus is in the stowed configuration to prevent rotational movement of the main body while in the stowed configuration.

17. The method of claim 16, further comprising using a J-cup surface of a bar shield of the main body any time the safety bar apparatus is in the stowed configuration.

18. The method of claim 16, further comprising using a landing surface located on an upper-facing side of the main body during the performance of exercise and while the safety bar apparatus is in the deployed configuration.

19. The method of claim 16, wherein the lowering the main body to abut the weight rack is achieved by using an upside down U-shaped or flat main body.

* * * * *